US005292048A

United States Patent [19]

Vanderwiel

[11] Patent Number: 5,292,048

[45] Date of Patent: Mar. 8, 1994

[54] SEMIAUTOMATIC LUMBER TAG STAPLER

[75] Inventor: James J. Vanderwiel, Cary, Ill.

[73] Assignee: Weber Marking Systems, Inc., Arlington Heights, Ill.

[21] Appl. No.: 807,139

[22] Filed: Dec. 13, 1991

[51] Int. Cl.[5] ..... B25C 7/00

[52] U.S. Cl. ..... 227/21; 227/47; 227/136

[58] Field of Search ..... 227/21, 47, 150, 121, 227/120, 46, 136, 76; 226/6, 8, 71, 151

[56] References Cited

U.S. PATENT DOCUMENTS

| | | | |
|---|---|---|---|
| 2,004,202 | 6/1935 | Horton . | |
| 2,346,070 | 4/1944 | Fuller | 226/71 |
| 2,351,557 | 6/1944 | Sweet et al. . | |
| 2,585,941 | 2/1952 | Juilfs . | |
| 2,978,705 | 4/1961 | Moberg . | |
| 2,996,720 | 8/1961 | Mackechnie | 227/76 |
| 3,319,864 | 5/1967 | Adams . | |
| 3,385,498 | 5/1968 | Downie . | |
| 4,014,488 | 3/1977 | Potucek et al. | 227/136 |
| 4,033,499 | 7/1977 | Butler . | |
| 4,077,289 | 3/1978 | Rudszinat . | |
| 4,581,964 | 4/1986 | Takatsuru . | |
| 4,615,475 | 10/1986 | Fuhrmeister | 227/136 |
| 5,014,896 | 5/1991 | Retmeier et al. | 227/39 |

FOREIGN PATENT DOCUMENTS

| | | |
|---|---|---|
| 1245509 | 10/1960 | France . |
| 941161 | 11/1963 | United Kingdom . |
| 2160464A | 12/1985 | United Kingdom . |

*Primary Examiner*—Richard K. Seidel
*Assistant Examiner*—Allan M. Schrock
*Attorney, Agent, or Firm*—Wallenstein, Wagner & Hattis, Ltd.

[57] ABSTRACT

The invention is a semiautomatic stapler for affixing a tag from a roll of tags onto a surface. The stapler includes a rotatable pivot indexing arm for moving the tag into position for affixing onto the surface. A cylinder may be provided for rotating the indexing arm, and an index stop pin is provided for limiting pivotable movement of the rotatable pivot indexing arm. In this way, tags of various lengths may be affixed by the stapler. The roll of tags is held within the automatic stapler.

12 Claims, 3 Drawing Sheets

SEMIAUTOMATIC LUMBER TAG STAPLER

TECHNICAL FIELD

The present invention relates generally to semiautomatic devices for securing tags or labels onto a surface. Particularly, the invention is best suited for securing coded tags onto the ends of lumber.

BACKGROUND OF THE INVENTION

Lumber is increasingly being sold in self-service lumber or hardware stores. Typically, the lumber has been pre-sized and cut into standard lengths. Thus, UPC-type bar codes may be secured onto the ends of these lengths in order to permit fast and accurate checkout at cashiers' stands.

Typically, hundreds of stacked lumber pieces can be arranged in tightly packed rows and columns. A UPC bar-coded tag may be secured to one end of each of these pieces. Thus, it was desirable to manufacture a device which would enable persons to affix to lumber a large number of tags in a relatively short period of time.

One such device is disclosed in U.S. Pat. No. 5,014,896 (hereinafter the "'896 patent"), issued to Reitmeier et al. on May 14, 1991, and entitled "Staple Gun For Attaching Labels." The '896 patent discloses a device which has a body for engaging labels. This body is shiftably movable between the extremities of a straight, elongated, longitudinal slot. The labels being moved by this body approach the bottom of the slot in a vertical orientation. At a point beyond the bottom of this longitudinal slot, the labels must make a rapid and sharp transition to a horizontal orientation. This transition is aided by a relatively small radius bend, as shown in the lower left corner of FIG. 3 of the '896 patent. It is estimated that the radius of this bend is no more than 0.75 inches. As a result of this relatively sharp transition, there is an increased possibility that labels may jam in this transition area while they are being fed towards the stapler head.

An insert is carried by this body and engages the labels. As described in column 5, lines 9–20, and as shown in FIGS. 6 and 9 of the '896 patent, this insert is also movable, and shifts away from the strip of labels when the label-engaging body shifts from its second position to its first position.

The device disclosed in the '896 patent apparently did not provide for the feeding of labels or tags of varying lengths. In fact, it is known by the inventor of the present invention that separate commercial versions of this device are manufactured to accommodate labels having differing lengths.

SUMMARY OF THE INVENTION

The invention is a semiautomatic stapler for affixing a tag from a roll of tags onto a surface. The stapler comprises a rotatable pivot indexing arm for moving the tag into position for affixing onto the surface. Means are provided for rotating the indexing arm, and integral means are provided for supporting the roll of tags within the automatic stapler. The means for rotating the indexing arm may comprise a pneumatically-operated piston and cylinder.

In yet another embodiment of the invention, the semiautomatic stapler is provided with an index stop pin for limiting pivotable movement of the rotatable pivot indexing arm. In this way, the stapler of the invention is adaptable to advance tags of varying lengths.

In a further embodiment of the invention, the stapler comprises a cutoff knife actuated by a block secured to a cylinder rod. The cutoff knife engages and cuts a tag from the roll. The tag is advanced through the action of a spring-biased pawl secured to the pivot indexing arm. Particularly, a drive hole in one of the tags is engaged by the pawl, which then moves the tag forward towards a stapling end of the stapler. Upon advancement, the tag is properly positioned for affixing onto the surface.

DETAILED DESCRIPTION OF THE PREFERRED EMBODIMENT

The invention is shown in the accompanying FIGS. 1–5. The device is a semiautomatic stapler 10 for affixing, onto a surface 11, an individual tag from a roll of tags 12.

Figure 1:
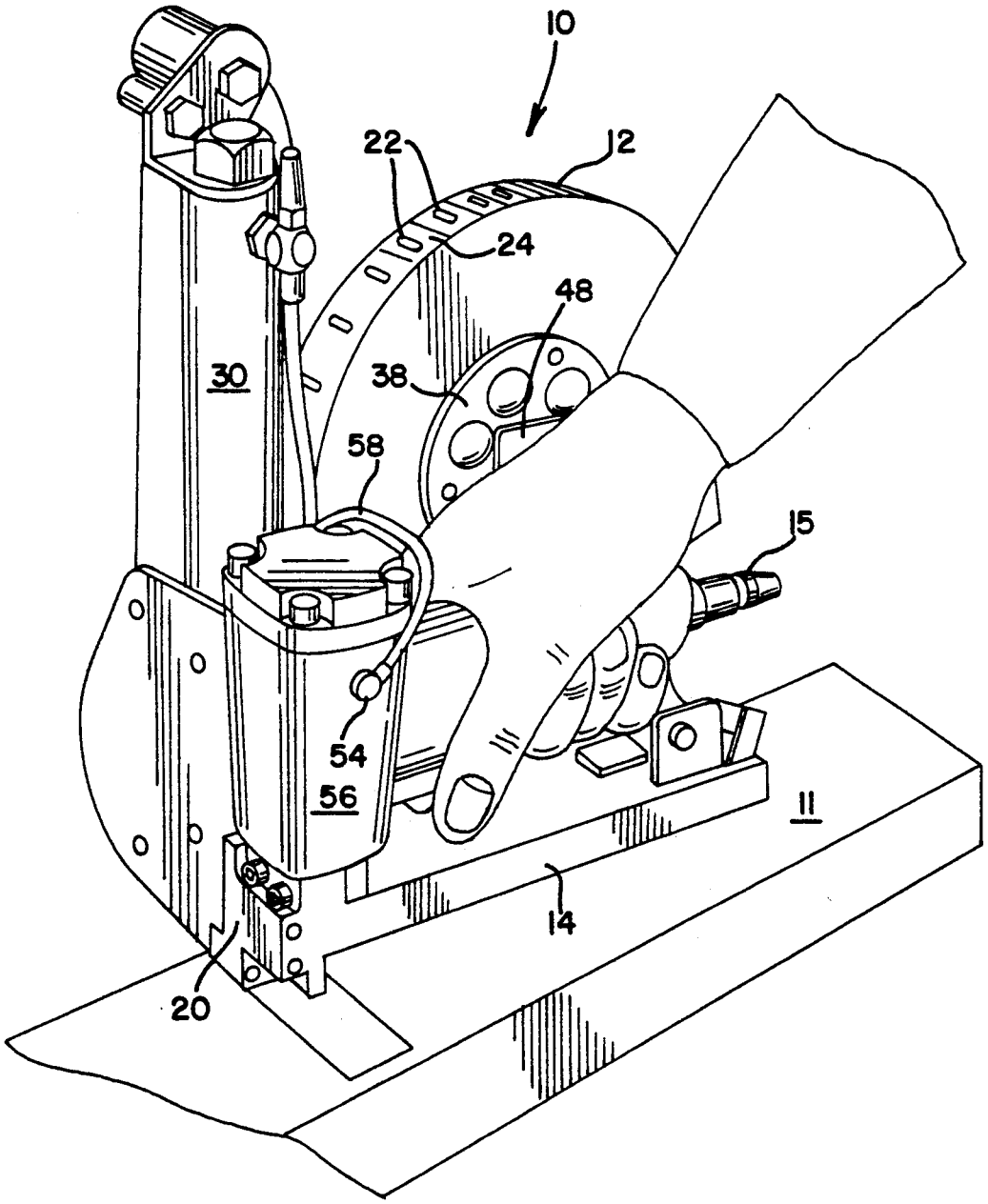
FIG. 1 is a perspective view of the semiautomatic tag stapler of the invention.

One component of the invention is conventional and may be acquired from a commercial staple gun manufacturer. This component is shown in FIG. 1 and comprises a pneumatic staple gun 14. For example, the preferred device is made using a Bostitch TU 20–11 staple gun, which uses Bostitch galvanized staple Nos. SP3023-3/8ths. An air supply fitting 15 is provided at the back end of this staple gun 14. In this embodiment, the staple gun is secured to the remaining structure at three points. These three points include an S-shaped strap 16, shown in FIG. 5; a flat strap 18, shown in FIG. 2; and a nose piece 20, shown in FIGS. 1, 4 and 5.

Figure 2:
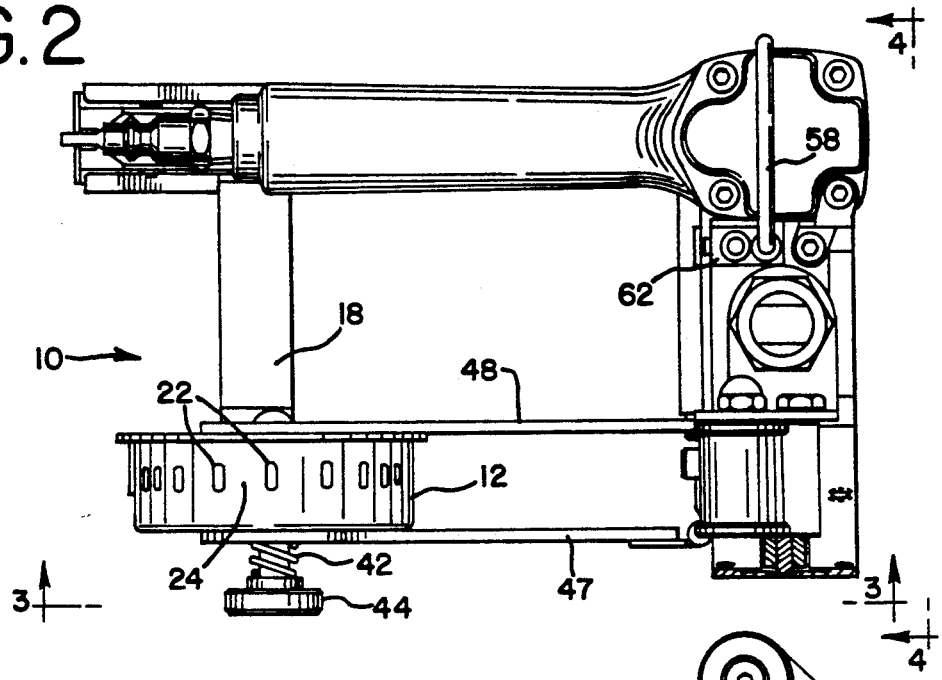
FIG. 2 is a top view, partially in section, of the semiautomatic tag stapler of FIG. 1.

Typically, these tags have a drive hole or slot 22, as shown in FIGS. 1 and 2, which facilitate their advancement within the device. An individual tag 24 is defined by and located between a pair of adjacent drive holes 22.

The stapler comprises a rotatable pivot indexing arm 26 for repetitively moving each individual tag 24 into the proper position. An element is provided on the indexing arm 26 for engaging a drive hole 22. As will be explained below in more detail, this element sweeps the tag 24 into the appropriate position for stapling. From this position, the tag 24 may then be affixed onto the surface 11.

Means are provided for rotating the indexing arm 26 along a radial path 28. In this embodiment, these means may comprise a pneumatically-operated cylinder 30, a return spring (not shown) within that cylinder 30, and its associated piston. Although this piston is not shown, its connecting arm 32 is shown. The cylinder 30 is available from Humphrey as No. 6-SP-2 with options B and H, and with a 12 pound return spring.

Integral means 34 are provided for supporting the roll of tags 12 within the semiautomatic stapler 10. In this embodiment, these means 34 comprise a spool 38 held on an axle 40. The means 34 include a hinged side plate 47 and a fixed side plate 48. The hinged side plate 47 moves outwardly about a pivot point to permit loading of spool 38. The spring 42 providing the tensioning on the hinged side plate 47 is held near that plate 47 by a threadably engaged thumbwheel 44. The SPEC spring 42 has a tension of 2½ to 3 pounds, and is available from Barnes Group, Inc., as Part No. C0420-035-0620-S.

The semiautomatic stapler 10 may be provided with an index stop pin 46 for limiting pivotable movement of the rotatable pivot indexing arm 26. In this way, the stapler 10 of the invention is adaptable to advance tags of varying lengths.

The stapler 10 also comprises a cutoff knife 36 actuated by the downward movement of the connecting arm 32. One component of this cutoff knife 36 is caused to move upon downward movement of the connecting arm 32 to engage and cut a tag 24 from its roll 12. The tag 24 is advanced with a spring-biased pawl 50 secured to the pivot indexing arm 26. Particularly, the drive hole 22 in one of the tags 24 is engaged by the pawl 50, which then moves the tag 24 forward towards a stapling end 52 of the stapler 10. Upon advancement, the tag 24 is positioned for affixing onto a suitable surface.

Having provided a general overview of the apparatus, a more detailed description of the components and their operation will follow.

The tags 24 that may be used with the present invention may be of various sizes. In the embodiment of FIGS. 1-5, the stapler 10 has been sized for labels that have lengths that are integral multiples of each other, e.g., labels having a length of either 1⅜ or 2¾ inches.

FIG. 1 shows a 90 degree generally hollow tube fitting 54 that is threadably secured to a threaded orifice (not shown) in a side wall 56 of the pneumatic staple gun 14. The tube fitting 54 is available as Beswick Part No. MLAS-1132-ENP. The threaded orifice is not a part of the standard staple gun 14, but may be drilled into the side wall 56 by the user. The portion of the gun 14 enclosed by this side wall 56 is filled with pressurized air from the air source supplying the air supply fitting 15. Thus, the 5/32 inch pneumatic tubing line 58 leading from this tube fitting 54 is constantly pressurized with air at 60-100 pounds per square inch gauge (psig). This tubing is manufactured by Alcon Tubing and is sold as Catalog No. PO 5/32 - BL.

One end of this tubing line 58 and one end of a second length 60 of the same tubing enter a three-way valve 62 available from Kuhnke GmbH, Germany, as Model No. 72.010. When the semiautomatic stapler 10 is at rest, the three-way valve 62 is closed and does not permit the passage of air from pressurized line 58 to second line 60.

Figure 3:
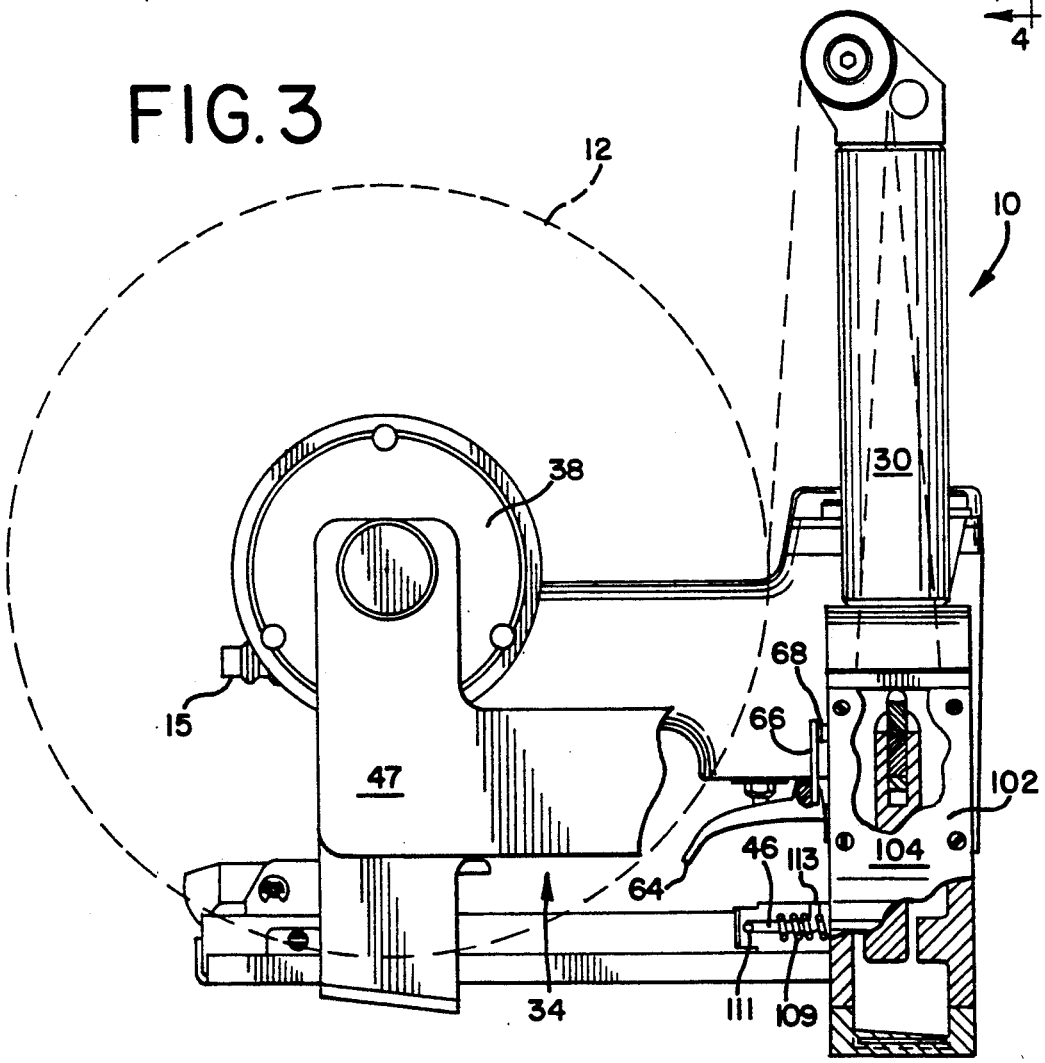
FIG. 3 is a side view of the semiautomatic tag stapler of FIG. 2, partially in section, and taken along lines 3—3.

As shown in FIG. 3, however, when the stapler 10 is actuated by depressing trigger 64, that trigger strikes a paddle 66 and the paddle, in turn, activates a plastic stem 68 that is an integral part of the three-way valve 62. When this stem 68 is activated, the three-way valve 62 is opened, and pressurized air moves from pressurized line 58 through second line 60 and then into cylinder 30. As may be seen in FIG. 5, the presence of pressurized air in cylinder 30 causes the extension of the piston (not shown) and its connecting arm 32.

As this connecting arm 32 is extended, a nose block 70 secured to connecting arm 32 is pushed into engagement with a lever 72. This lever 72 has a cutout or depressed portion 74 into which fits the pointed end of the nose block 70. As it is pushed down by the nose block 70, lever 72 pivots about pivot point 76 and moves a top knife 78 downwardly. This top knife 78 provides a scissors or cutting action in conjunction with bottom knife 80, and thereby cuts the individual tag 24 that is adjacent the stapling end 52 of the stapler 10.

Figure 4:
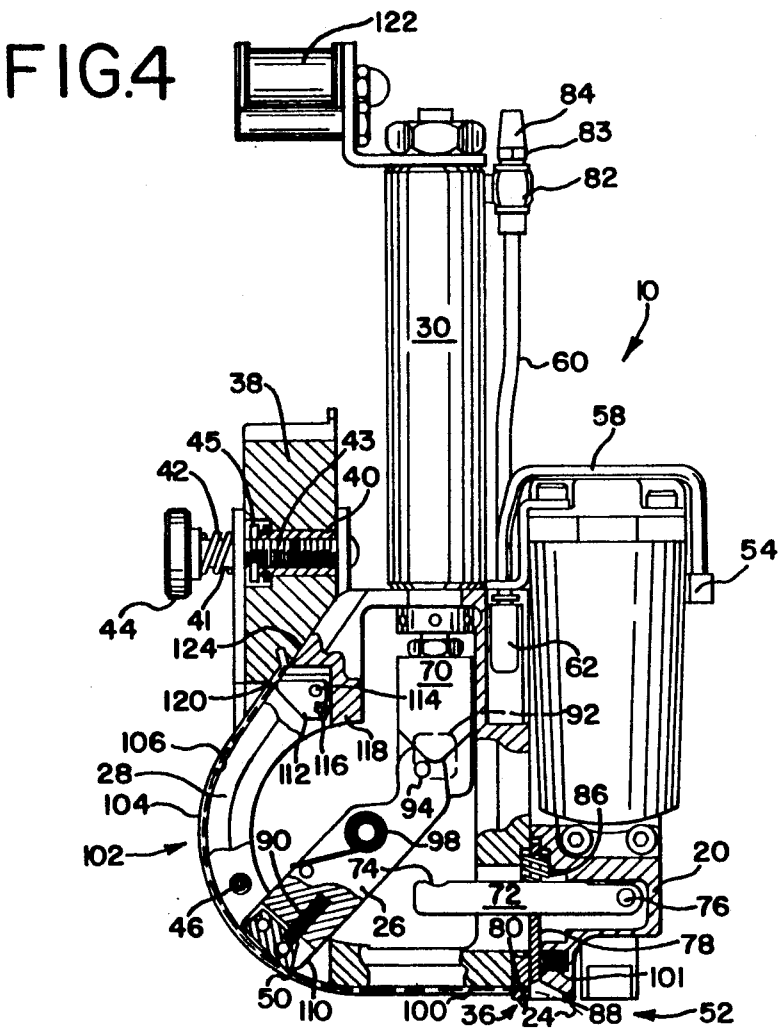
FIG. 4 is a front view, partially in section, and taken along lines 4—4 of FIG. 2, of the semiautomatic tag stapler of FIG. 1, with the pivot indexing arm in a resting position.

When the trigger 64 is released, a portion of the three-way valve 62 opens to atmosphere to permit some of the air in the cylinder 30 and the second length 60 of tubing to escape. Simultaneously, a plate in a quick exhaust valve 82 (available from Humphrey as Part No. SQE) switches positions and permits the remaining air in the cylinder 30 to be exhausted through this valve 82 and a muffler 84, available from McMaster-Carr as Catalog No. 4450 K 31. A choke 83 (Beswick No. CC-1010-055 ENP) helps regulate the speed of indexing arm 26 by regulating the speed at which air escapes. A spring 86 acts upon the top knife 78 to return the lever 72 to its original position, as shown in FIG. 4. This spring 86 is available as SPEC No. C0300-038-0810-S and has a force of 7.3 pounds.

In order to best understand the invention, the action and function of the pivot indexing arm 26 must also be explained in detail. In the resting position of FIG. 4, a tag 24 from the roll of tags 12 is positioned to the right of the top 78 and bottom knives 80, as those directions are referenced in FIGS. 4 and 5. The individual tag 24 is biased downwardly by a sloping guide 88, ready for both stapling by the stapler 10 and, very shortly thereafter, for cutting upon actuation of the knife 78.

Spring-biased pawl 50 extends through drive hole or slot 22 of another individual tag 24. Pawl 50 has been in the rest position of FIG. 4 after having moved the endmost tags from the roll of tags 12 towards the stapling end 52 at the end of a previous cycle of the stapler 10. The pawl 50 is held in a tensioned state by a pawl spring 90, and is not precisely normal to a surface defined by the radial path 28 in which the indexing arm 26 moves. Rather, as may be seen in FIGS. 4 and 5, the end of the pawl 50 is angled such that it points in the direction of counterclockwise movement of the indexing arm 26. In this way, when the arm 26 moves in a counterclockwise direction, the pawl 50 engages a drive hole or slot 22 to move the tags forward. In contrast, when the arm 26 moves in a clockwise direction, the pawl 50 is removed from or disengages the slot 22. As a result, when the trigger 64 is actuated and the arm 26 moves in a clockwise direction, i.e., from the position of FIG. 4 to the position of FIG. 5, the tags remain stationary.

The nose block 70 includes a square drive hole 92 which permits dwell time for the indexing arm 26 after the trigger 64 has been released. Particularly, upon release of the trigger 64, air is discharged from the cylinder 30 and the connecting arm 32 is biased by cylinder return spring (not shown) in an upward direction. An index arm drive pin 94 is joined to the indexing arm 26 and movement of that pin 94 causes movement of the arm 26. As may be appreciated from FIG. 5, however, initial upward movement of the connecting arm 32 upon release of trigger 64 will not cause movement of the indexing arm 26. Substantial movement of the indexing arm occurs only when the bottom 96 of square drive hole 92 moves upward sufficiently to abut against the index arm drive pin 94. Dwell time occurs between the release of the trigger 64 and the abutment of the index arm drive pin 94 with the bottom 96 of square drive hole 92.

During this dwell time, one additional phenomena occurs. Particularly, when the trigger 64 has been activated and the indexing arm 26 is in the position shown in FIG. 5, the pawl 50 is disposed approximately 1/16 inch clockwise from the nearest adjacent drive hole or slot 22. During the dwell time, the cylinder 30 and nose block 70 are essentially disengaged from the indexing arm 26 and impart no external forces upon that arm 26. During this dwell time, however, a low-tension torsion spring 98 (SPEC No. T035-180-281-R, 1.3 pounds) gently moves the indexing arm about 1/16 inch counterclockwise until the pawl 50 engages the adjacent and next available drive hole 22. If this torsion spring 98 were not used to cause gentle engagement of the hole 22, the indexing arm 26 would instead be moved in a counterclockwise direction to engage the hole by the more rapid, forceful action of the cylinder 30 and nose block 70. This would increase the potential for both tearing of that drive hole 22 and consequent jamming of the stapler 10.

Dwell time is provided for one additional reason. As may be seen from FIG. 5, when the trigger 64 has been actuated, the top knife 78 and bottom knife 80 are adjacent. The adjacent disposition of these knives would prevent counterclockwise movement of the next individual tag 24 at the front of the line of tags 100 towards sloping guide 88. If dwell time were not provided, arm 26 would cause the front of the line of tags 100 to move forward immediately, causing a jam against the lowered top knife 78. Dwell time permits the top knife 78 to rise out of the way, opening a path for unobstructed movement of the front of the line of tags 100. As may also be seen in FIGS. 4 and 5, a spring 101 keeps top knife 78 tensioned against bottom knife 80. This spring 101 has a pressure of 3.6 pounds and is marketed by Barnes Group, Inc., as SPEC No. C0240-029-0500-S.

Figure 5:
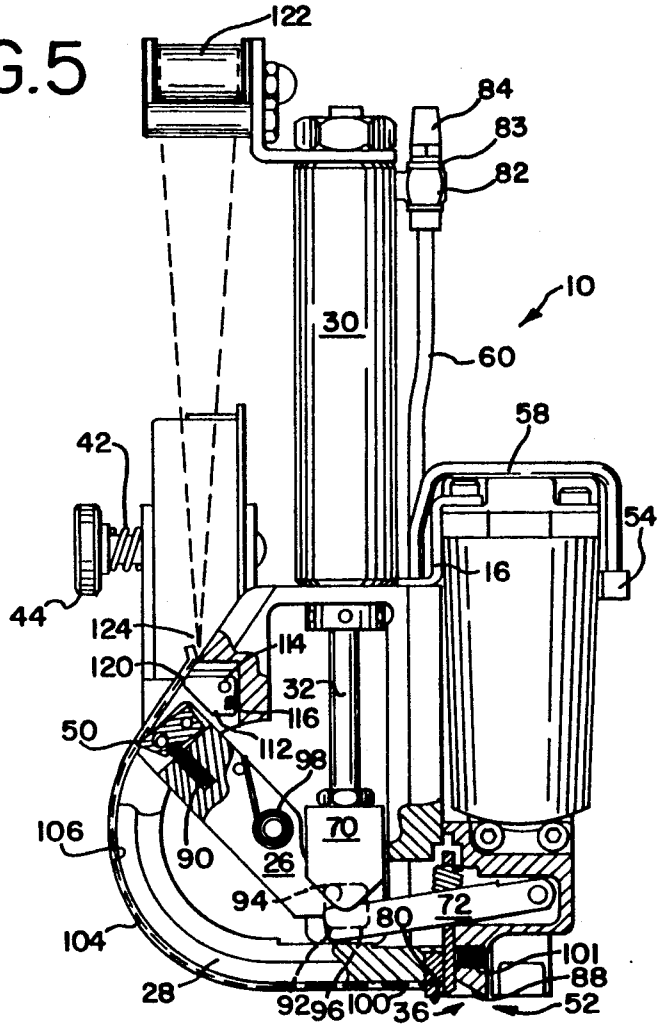
FIG. 5 is a front view like that of FIG. 4, again partially in section, showing the pivot indexing arm after pivoting to an upward position from which that arm advances the tag.

It will be understood from the above description and the figures that the pawl spring 90 maintains the pawl 50 in a radially-outwardly biased state. The pawl spring 90 is SPEC No. C0120-014-0810-S, rated at 0.57 pounds. The tip of pawl 50 extends well beyond the surface of the line of tags 100. As shown in FIGS. 4 and 5, the stapler 10 has a curved protective cover plate 102 which covers the line of tags 100. This curved cover plate 102 partially defines a path for the line of tags 100. The plate 102 has a preferred radius of approximately 1.75 inches which results in a smooth, gradual feeding of tags 24 to the stapling end 52. This cover plate 102, when secured to the stapler as shown in FIGS. 3–5, has an outer surface 104 which is visible to the user. The cover plate 102 also has an inner surface 106 which is not normally visible to the user and which is in very close proximity to the front line of tags 100. To prevent scoring of this inner surface by the outwardly-jutting pawl 50, the center of the inner surface includes a groove (not shown). This groove is sufficiently deep such that pawl 50 will not strike the inner surface 106 throughout the permitted range of motion of the arm 26 in the radial path 28. In the preferred embodiment, this groove is $\frac{1}{4}$ inches wide and 0.020 inches deep.

As indicated above, the stapler is suitable for tags 24 having varying lengths. The preferred embodiment of the device is suitable for handling tags 24 having lengths of $1\frac{3}{8}$ or $2\frac{3}{4}$ inches. The length of the tag handled by the stapler 10 depends upon the extent of the sweep of the indexing arm 26 along its radial path 28. The $2\frac{3}{4}$ inch tag is handled when the indexing arm 26 of the stapler 10 is able to attain a greater sweep, as depicted in FIGS. 4 and 5.

To enable the device to handle the smaller $1\frac{3}{8}$ inch tags, the sweep of the indexing arm 26 is limited. Limitation of the sweep is accomplished by extension of a round tag stop pin 46 into the radial path 28. With this stop pin 46 in place in the radial path 28, the pivot indexing arm 26 does not rest at the position shown in FIG. 4. Rather, it rests in a nearly horizontal position (not shown), with a lower edge 110 of the indexing arm 26 abutting against and being stopped by the extended stop pin 46. The fully extended stop pin 46 is positioned in the radial path 28 so that the resultant sweep of the pivot indexing arm 26 will be half the sweep of that arm 26 with the stop pin 46 retracted.

Various arrangements for withdrawing and extending the stop pin 46 will be apparent to one skilled in the art. One preferred arrangement for moving the stop pin 46 is shown in FIG. 3. Tension is provided through the use of a spring 109 (SPEC No. C0210-022-1250-S, 2.9 pounds maximum) in conjunction with pin 46. A second pin 111 is pressed into stop pin 46 and has a horizontal axis perpendicular to that of stop pin 46. A screwdriver is inserted into a slot at the left end of the pin 46 (FIG. 3), and that pin 46 is pushed forward, or to the right as that direction appears in FIG. 3. When the second pin 111 has reached vertical slot 113, the screwdriver is turned $\frac{1}{4}$ of a turn counterclockwise to lock the second pin 111 within that slot 113. When the second pin 111 is locked into vertical slot 113, the stop pin 46 is in its extended position, and the pivoting indexing arm 26 is limited to $\frac{1}{2}$ of its maximum sweep through radial path 28. Under these conditions, $1\frac{3}{8}$ inch labels may be attached with the stapler 10.

Release of the second pin 111 from the vertical slot 113 occurs through the turning of the second pin 111 $\frac{1}{4}$ turn in the clockwise direction. Upon such turning, the spring 109 returns the stop pin 46 to its normal retracted position as shown in FIG. 3. In this position, the full sweep of the indexing arm 26 along the radial path 28 is permitted, and $2\frac{3}{4}$ inch labels may be attached with the stapler 10.

Another feature of the preferred embodiment is a so-called antibackup pawl 112, which is shown in FIGS. 4 and 5. This antibackup pawl 112 pivots about a pivot point 114. A pawl spring 116 (SPEC No. C0120-012-0440-S, rated at 0.43 pounds) is captured in an internal cavity of pawl 112 and urges the pawl 112 into light engagement with the line of tags 100. The engagement should be light enough so that the counterclockwise movement of the tags will not be impeded. The engagement should, however, also be sufficient so that the pawl 112 pivots upward promptly upon any attempted clockwise movement of the tags. Such clockwise movement of the tags may occasionally be caused, for example, by clockwise movement of the indexing arm 26. Given the shape of the pawl 112, its upward pivotal movement will cause the tip 120 of the pawl 112 to tightly grip the line of tags 100 against the inner surface 106 of curved cover plate 102. In this way, unintended clockwise movement of the line of tags 100 is prevented.

As noted above, the stapler is provided with a tensioned spool 38 upon which tags are held. The thumbwheel 44 is turned so that spring 42 (SPEC No. C040-035-0620-S, 3.2 pounds) is tensioned sufficiently to prevent freewheeling of the spool 40, and yet lightly enough so that the pivot indexing arm 26 can move the line of tags 100 when the arm 26 makes its counterclockwise sweep. This correct level of tensioning is provided automatically by the construction shown the cross-sectional portion of FIG. 4. The thumbwheel 44 includes a rod 41 having a threaded outer end 43. Upon turning of the thumbwheel 44, this threaded outer end 43 engages the corresponding internally threaded axle 40. A pin 45 is secured near the middle of rod 41. The abutment of this pin 45 against an end of the axle 40, as shown in FIG. 4, stops further rightward movement of the thumbwheel 44 and automatically provides the correct amount of tension.

The tags pass from the spool 38 over a twist roller 122 before entering a slot 124 at the top of the cover plate 102. Between the twist roller 122 and the slot 124, the line of tags is turned 90 degrees.

While the specific embodiments have been illustrated and described, numerous modifications come to mind without markedly departing from the spirit of the invention. The scope of protection is thus only intended to be limited by the scope of the accompanying Claims.

What I claim is:

1. A semiautomatic stapler for affixing a tag from a roll of tags onto a surface, said stapler comprising:

a. an indexing arm for engaging and moving said tag along an arcuate path into position for affixing, said indexing arm having a ticket engaging end and an opposing end, said indexing arm being rotatable about a pivot positioned between said engaging end and said opposing end;

b. means directly connected to said indexing arm opposing end for rotating said ticket engaging end of said indexing arm along said arcuate path; and c. integral means for supporting said roll of tags within said automatic stapler.

2. The semiautomatic stapler of claim 1, further comprising an index stop pin for limiting pivotable movement of said rotatable pivot indexing arm, and thereby permitting said stapler to advance tags of varying lengths.

3. The semiautomatic stapler of claim 1, further comprising a cut-off knife, said cut-off knife engaging and cutting a tag from its roll; and a pawl secured to said pivot indexing arm for engaging a drive hole in one of said tags, so that said tag may be advanced into position for affixing onto said surface.

4. The semiautomatic stapler of claim 1, wherein said means for rotating said indexing arm comprises a cylinder having a movable piston.

5. The semiautomatic stapler of claim 4, wherein said cylinder is pneumatically actuated.

6. The semiautomatic stapler of claim 3, wherein said pawl is spring-biased.

7. A semiautomatic stapler for affixing a tag from a roll of tags onto a surface, said stapler comprising:

a. a rotatable pivot indexing arm for moving said tag into position for affixing;

b. means for rotating said indexing arm along an arcuate path said arcuate path having a first end and a second end;

c. integral means for supporting said roll of tags within said automatic stapler;

d. an index stop pin located between said first and second ends along said arcuate for limiting pivotable movement of said rotatable pivot indexing arm, and thereby permitting said stapler to advance tags of varying lengths;

e. a cutoff knife to engage and cut a tag from its roll; and f. a pawl secured to said pivot indexing arm for engaging a drive hole in one of said tags, so that said tag may be advanced into position for affixing onto said surface.

8. The semiautomatic stapler of claim 7, wherein said means for rotating said indexing arm comprises a cylinder having a movable piston.

9. The semiautomatic stapler of claim 8, wherein said cylinder is pneumatically actuated.

10. The semiautomatic stapler of claim 7, wherein said pawl is spring-biased.

11. A semiautomatic stapler for affixing a tag from a roll of tags onto a surface, said stapler comprising:

a. a rotatable pivot indexing arm for moving said tag into position for affixing;

b. a pneumatically-actuated cylinder having a movable piston for rotating said indexing arm along an arcuate path said arcuate path having a first end and a second end;

c. integral means for supporting said roll of tags within said automatic stapler;

d. an index stop pin located between said first and second ends along said arcuate for limiting pivotable movement of said rotatable pivot indexing arm, and thereby permitting said stapler to advance tags of varying lengths;

e. a cutoff knife to engage and cut a tag from its roll; and f. a spring-biased pawl secured to said pivot indexing arm for engaging a drive hole in one of said tags, so that said tag may be advanced into position for affixing onto said surface.

12. A semiautomatic stapler for affixing a tag from a roll of tags onto a surface, said stapler comprising:

a. a rotatable pivot indexing arm for moving said tag into position for affixing;

b. means for rotating said indexing arm along an arcuate path;

c. integral means for supporting said roll of tags within said automatic stapler; and d. an index stop pin located between said first and second ends along said arcuate path for limiting pivotable movement of said rotatable pivot indexing arm, and thereby permitting said stapler to advance tags of varying lengths.

* * * * *